US005970736A

United States Patent [19]

Gong et al.

[11] Patent Number: 5,970,736

[45] Date of Patent: Oct. 26, 1999

[54] REFRIGERATOR CAPABLE OF CONTROLLING COOL AIR SUPPLY INTO A COOLING COMPARTMENT AND A VEGETABLE CHAMBER

[75] Inventors: I-gu Gong; Yang-beom Hur, both of Suwon, Rep. of Korea

[73] Assignee: Samsung Electronics Co., Ltd., Suwon, Rep. of Korea

[21] Appl. No.: 09/084,885

[22] Filed: May 28, 1998

[30] Foreign Application Priority Data

Jul. 26, 1997 [KR] Rep. of Korea ..... 97-19922
Aug. 28, 1997 [KR] Rep. of Korea ..... 97-41908

[51] Int. Cl.[6] ..... F25D 17/04

[52] U.S. Cl. ..... 62/408; 62/419

[58] Field of Search ..... 62/407, 408, 441, 62/419, 186, 187

[56] References Cited

U.S. PATENT DOCUMENTS 3,403,533 10/1968 Bollenbacher ..... 62/408
4,229,945 10/1980 Griffin et al. ..... 62/229
4,732,014 3/1988 Frohbieter ..... 62/382
4,920,758 5/1990 Janke et al. ..... 62/187
5,212,962 5/1993 Kang et al. ..... 62/382

FOREIGN PATENT DOCUMENTS 6-82144 3/1994 Japan .
8-504939 5/1996 Japan .

*Primary Examiner*—William Doerrler
*Attorney, Agent, or Firm*—Burns, Doane, Swecker & Mathis, L.L.P.

[57] ABSTRACT

A refrigerator capable of controlling supply of cool air into a fresh food compartment and a vegetable chamber is disclosed. A cool air duct is formed at a rear part of the fresh food compartment. The cool air duct has discharge ports for supplying the cool air into the fresh food compartment and the vegetable chamber. The discharge ports are opened and closed by an opening/closing device. The device opens/closes the discharge ports formed at the fresh food compartment and the vegetable chamber simultaneously. Therefore, when the supply of the cool air into the fresh food compartment is stopped, the supply of the cool air into the vegetable chamber is stopped too, and thereby the overcooling of the vegetable chamber is prevented.

3 Claims, 5 Drawing Sheets

REFRIGERATOR CAPABLE OF CONTROLLING COOL AIR SUPPLY INTO A COOLING COMPARTMENT AND A VEGETABLE CHAMBER

BACKGROUND OF THE INVENTION

1. Field of the Invention

The present invention relates to a refrigerator, and more particularly, to a refrigerator capable of controlling supply of cool air into a cooling compartment and a vegetable chamber.

2. Related Art

As shown in FIG. 1, a general refrigerator has a body 1 forming a freezing compartment 2 and a fresh food compartment 5, doors 3 and 6 for opening/closing the freezing compartment 2 and the fresh food compartment 5 respectively. At the rear part of the freezing compartment 2, an evaporator 7 for generating cool air and a fan 8 for supplying the cool air generated by the evaporator 7 into the cooling compartment 2 and 5 are installed.

The fresh food compartment 5 is partitioned into a plurality of spaces by a plurality of shelves 9. The lowermost space among the partitioned spaces is used for a vegetable chamber 10 for storing vegetables. In general the vegetable chamber 10 is maintained to a temperature somewhat higher than the temperature of the fresh food compartment 5.

At the rear part of the fresh food compartment 5, a duct member 16 being formed with a plurality of cool air discharge ports 16*a* is installed. The duct member 16 forms a cool air duct 11 vertically at the rear part of the fresh food compartment 5. The cool air discharge ports 16*a* are formed at positions corresponding to the spaces partitioned by the shelves 9.

A part of the cool air blown by the fan 8 flows into the cool air duct 11, and the cool air flowing into the cool air duct 11 is discharged into the fresh food compartment 5 through the cool air discharge ports 16*a*. Then, the food placed on the shelves 9 is cooled. In the cool air duct 11, a guide device 13 for guiding the cool air flowing into the cool air duct 11 toward the cool air discharge ports 16*a* is installed.

The cool air discharge ports 16*a* are formed at the frontal side and the lower side of the duct member 16. The cool air discharged through the cool air discharge ports 16*a* formed at the frontal side of the duct member 16 is supplied into the fresh food compartment 5, and the cool air discharged through the cool air discharge ports 16*a* formed at the lower side of the duct member 16 is supplied into the vegetable chamber 10. Thus, the food stored in the fresh food compartment 5 and the vegetables stored in the vegetable chamber 10 are cooled.

The supply of the cool air into the fresh food compartment 5 is controlled by a separate opening/closing device (not shown). That is, the refrigerator is equipped with an opening/closing device for opening/closing the cool air discharge ports 16*a*. The opening/closing device opens the cool air discharge ports 16*a* to supply the cool air into the fresh food compartment 5 when the temperature of the fresh food compartment 5 is high, and closes the cool air discharge ports 16*a* to stop supplying the cool air when the temperature of the fresh food compartment 5 is low. Then, the temperature of the fresh food compartment 5 is maintained to a desired temperature by opening/closing the cool air discharge ports 16*a* according to the temperature of the fresh food compartment 5 as described above.

However, in such a conventional refrigerator, although the supply of cool air is stopped by the opening/closing device when the temperature of the fresh food compartment 5 is maintained to a temperature lower than the desired temperature, the vegetable chamber 10 is continuously supplied with the cool air through the cool air discharge ports 16*a* formed at the lower side of the duct member 16, so there is a problem that the vegetables stored in the vegetable chamber 10 may be overcooled.

SUMMARY OF THE INVENTION

The present invention has been proposed to overcome the above described problems in the prior art, and accordingly it is the object of the present invention to provide a refrigerator which can prevent the overcooling of the vegetables by opening/closing all the discharge ports opened in a cooling compartment and a vegetable chamber.

To achieve the above object, the present invention provides a refrigerator comprising: a body for forming a cooling compartment and a vegetable chamber which are partitioned from each other; an evaporator for generating cool air; a duct member being formed with a plurality of cool air discharge ports opened in the cooling compartment and the vegetable chamber, the duct member for forming a cool air duct for guiding the cool air generated from the evaporator, the duct member for discharging the cool air into the cooling compartment and the vegetable compartment through the cool air discharge ports; and a means for opening/closing the cool air discharge ports.

Here, the opening/closing means comprises: a plurality of opening/closing members being pivotably installed near the cool air discharge ports, the opening/closing members for opening/closing the cool air discharge ports according to a pivoting position thereof; a link with which the opening/closing members are hingedly assembled, the link being formed with a rack at a part thereof; a pinion being engaged with the rack; and a means for driving the pinion.

According to another embodiment of the present invention, the opening/closing means comprises: a plurality of opening/closing members being pivotably installed near the cool air discharge ports, the opening/closing members for opening/closing the cool air discharge ports according to a pivoting position thereof; a driving motor for driving the opening/closing member; a first cam member being rotated by the driving motor; a link reciprocating according to the rotation of the first cam member; and a plurality of second cam members for pivoting the opening/closing members respectively as the link reciprocates.

Preferably, the opening/closing members has a part superposed form-fittingly with each other when the opening/closing members pivot to close the cool air discharge ports. Therefore, the cool air discharge ports are closed more airtightly, and the leakage of the cool air is efficiently cut off when the cool air discharge ports are closed.

BRIEF DESCRIPTION OF THE DRAWINGS

The present invention will be better understood and its various objects and advantages will be more fully appreciated from the following description taken in conjunction with the accompanying drawings, in which.

DETAILED DESCRIPTION OF THE PREFERRED EMBODIMENT

Figure 1:
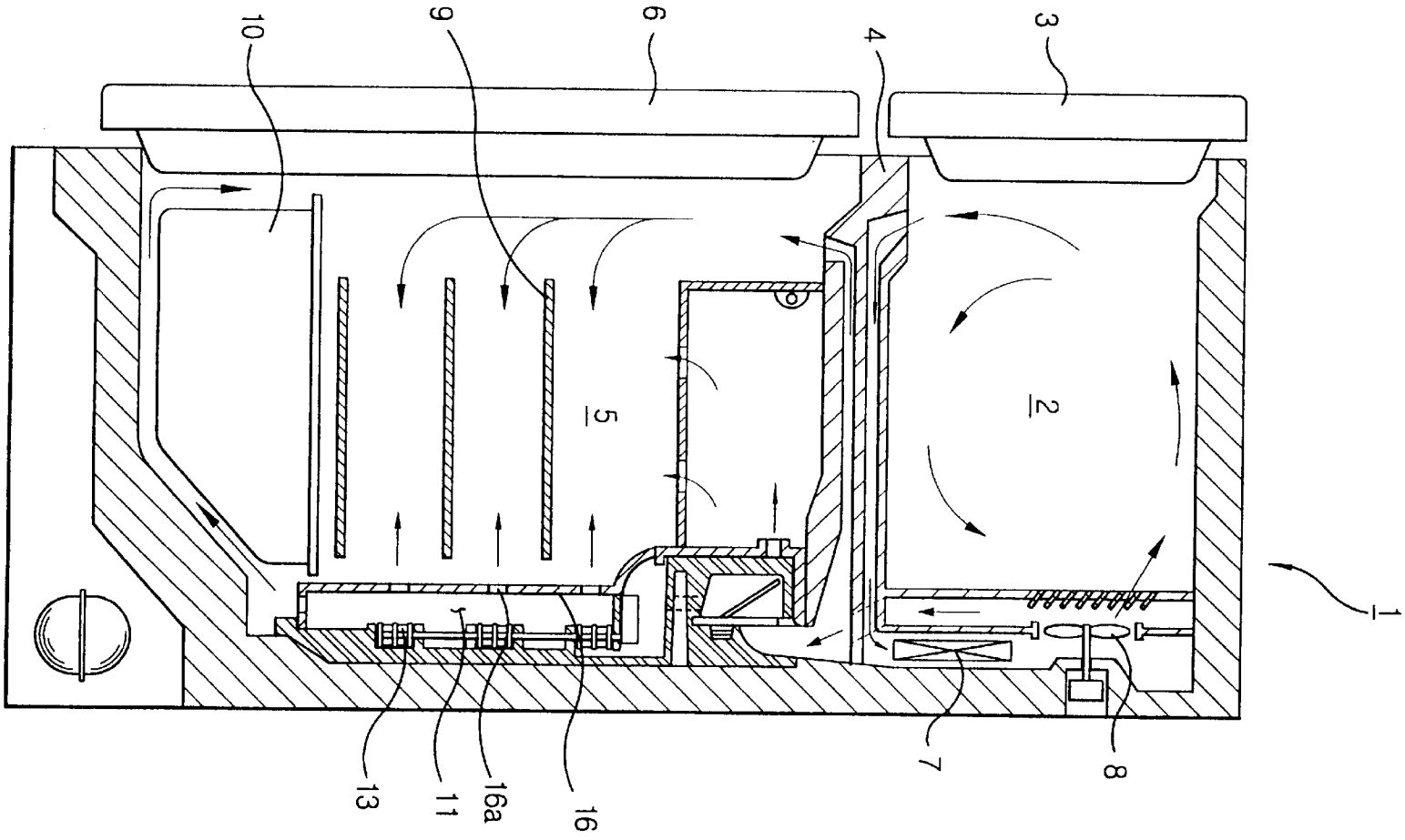
FIG. 1 (PRIOR ART)
FIG. 1 is a side sectional view of a general refrigerator.

Hereinafter, the present invention will be described in detail with reference to the drawings. The same parts with the parts of the conventional refrigerator shown in FIG. 1 will be referred to with the same reference numerals, and the description thereof will be omitted.

Figure 2:
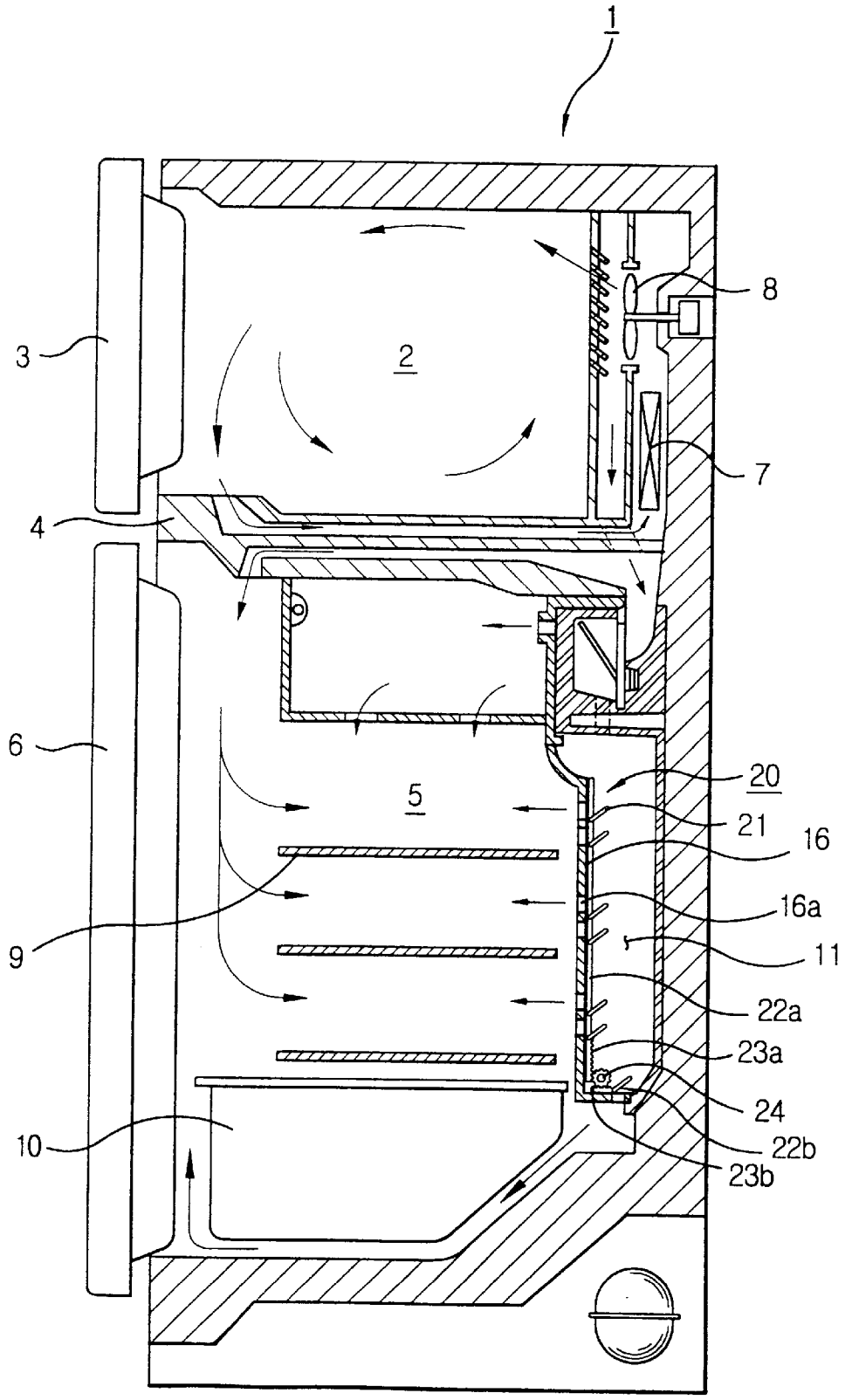
FIG. 2 is a side sectional view of a refrigerator according to the present invention.
Figure 3:
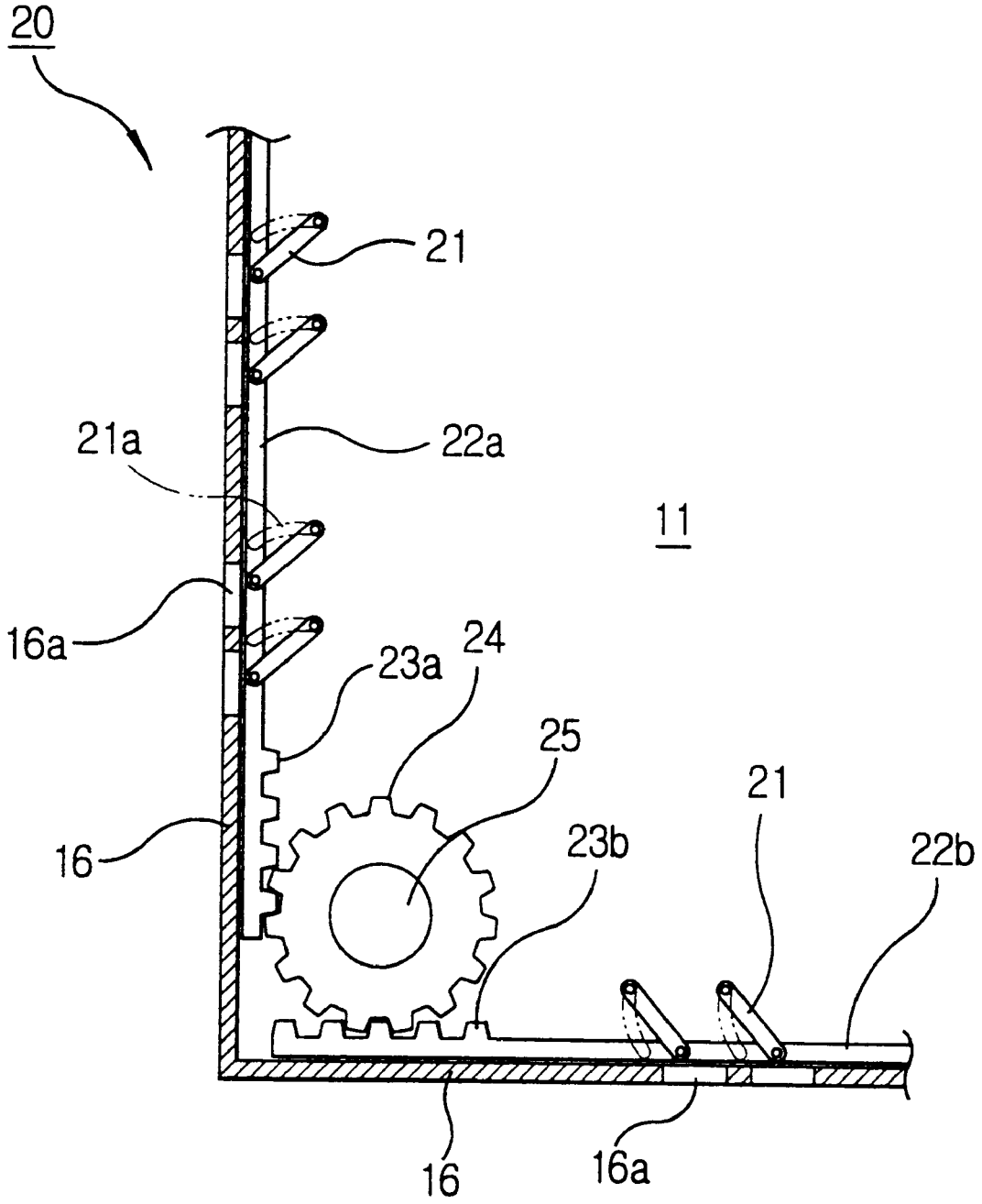
FIGS. 3 and 4 are enlarged side views of the opening/closing device shown in FIG. 2.
Figure 4:
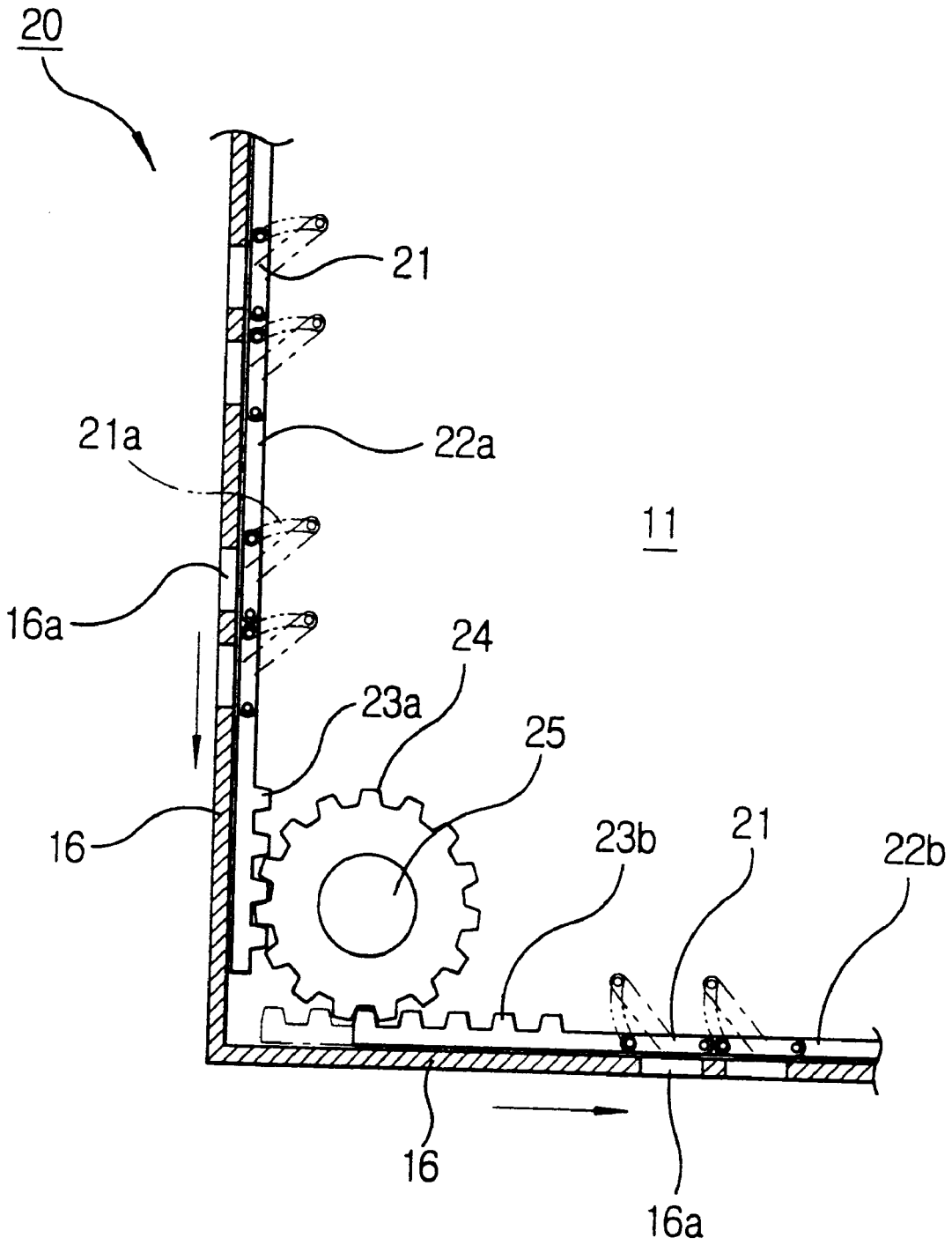

FIG. 2 is a side sectional view of a refrigerator according to the present invention, FIGS. 3 and 4 are enlarged side views of the opening/closing device shown in FIG. 2.

In the cool air duct 11, a device 20 for opening/closing the cool air discharge ports 16*a* is installed. The opening/closing device 20 is comprised of, as shown in FIGS. 3 and 4, a plurality of opening/closing members 21, a pair of links 22*a* and 22*b* being connected with the opening/closing members 21, and a pinion 24 for driving links 22*a* and 22*b*.

The opening/closing members 21 are pivotably mounted near the cool air discharge ports 16*a* formed at the frontal side of the duct member 16 and at the lower side of the duct member 16. The opening/closing members 21 are disposed at positions corresponding to the cool air discharge ports 16*a*.

The opening/closing members 21 are hingedly mounted on the links 22*a* and 22*b*. At a side of the duct member 16, a plurality of guide grooves 21*a* for guiding the pivoting of the links 22*a* and 22*b* are formed. When one link 22*a* is moved vertically and the other link 22*b* is moved horizontally, the opening/closing members 21 are guided by the guide grooves 21*a* which are bent, and accordingly the opening/closing members 21 pivot. The links 22*a* and 22*b* are formed with racks 23*a* and 23*b* respectively.

The pinion 24 is engaged with the racks 23*a* and 23*b*. The pinion 24 is assembled with the shaft 25 of a driving motor (not shown), and is rotated by the driving motor. When the driving motor rotates the pinion 24, the links 22*a* and 22*b* are moved.

Hereinbelow, the operation of the refrigerator having such a construction will be described.

The refrigerator senses the temperature in the freezing compartment 2 using a temperature sensor which is not shown. When the temperature of the freezing compartment 2 rises, the refrigerator performs cooling operation. Then the cool air is generated from the evaporator 7, and the generated cool air is blown by the fan 8 to flow into the freezing compartment 2. A part of the cool air flows into the cool air duct 11, and the cool air flowing into the cool air duct 11 is discharged toward the frontal side and the lower side of the duct member 16 through the cool air discharge ports 16*a*. Then, the cool air is supplied to the fresh food compartment 5 and the vegetable compartment 10. In this situation, the opening/closing device 20 maintains open state of the cool air discharge ports 16*a* as shown in FIG. 3.

When the temperature of the fresh food compartment 5 is sensed by the temperature sensor (not shown) to fall down below a desired temperature, the opening/closing device 20 begins to operate. The driving motor (not shown) drives the pinion 24 to move the links 22*a* and 22*b*. Then the opening/closing members 21 pivot, and thereby the cool air discharge ports 16*a* are closed by the opening/closing members 21 as shown in FIG. 4. In this situation, the opening/closing members 21 closes all of the cool air discharge ports 16*a* opened in the fresh food compartment 5 and the vegetable chamber 10. Therefore, the supply of the cool air to the fresh food compartment 5 and the vegetable chamber 10 is stopped, and the overcooling of the vegetables stored in the vegetable chamber 10 is prevented.

When the temperature of the fresh food compartment 5 rises to a higher temperature than the desired temperature, the opening/closing device 20 operates again, and thereby the opening/closing members 21 open the cool air discharge ports 16*a* as shown in FIG. 3. Therefore, the fresh food compartment 5 and the vegetable chamber 10 are supplied with the cool air.

Figure 5:
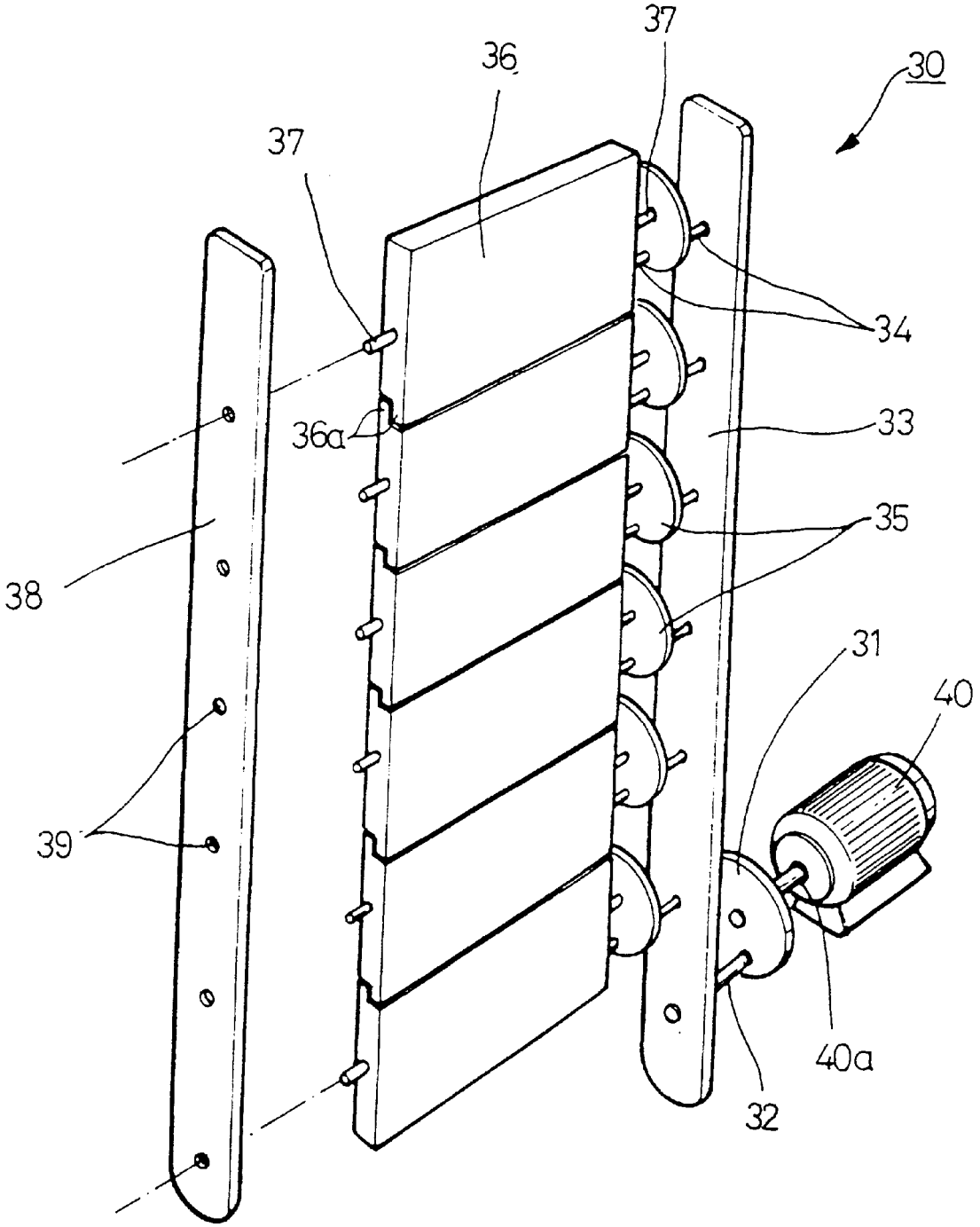
FIG. 5 is another embodiment of the present invention.

FIG. 5 is another embodiment of the present invention. In this embodiment, the opening/closing device 30 is comprised of a plurality of opening/closing members 36, a fixing link 38 for fixing the opening/closing members 36, a driving motor 40 for driving the opening/closing members 36, a first cam member 31 being driven by the driving motor 40, an operation link 33 being operated by the first cam member 31, and a plurality of second cam members 35 connected with the operation link 33.

The opening/closing members 36 are disposed near the cool air discharge ports 16*a* formed at the frontal side of the duct member 16 and at the lower side of the duct member 16. The opening/closing member 36 has hinge pins 37 at both sides thereof. On hinge pin 37 of the opening/closing member 36 is assembled with an assembly hole 39 of the fixing link 38, and the other hinge pin 37 thereof is connected to the second cam member 35. Therefore, the opening/closing member 36 is fixed to be capable of pivoting about the hinge pin 37.

In FIG. 5, the opening/closing members for opening/closing the cool air discharge ports 16*a* opened at the vegetable chamber 10 is not shown, however, the same members with the opening/closing members 36, the cam members 31 and 35, and the operation link 33 are installed in order to open and close the cool air discharge ports 16*a* formed at the lower side of the duct member 16. The opening/closing members 36 are disposed at positions corresponding to the cool air discharge ports 16*a* respectively.

The central part of the first cam member 31 is connected to the shaft 40*a* of the driving motor 40, and a first cam shaft 32 is formed at the side part thereof. The first cam shaft 32 is assembled with the operation link 33. When the first cam shaft 32 is rotated by the driving motor 40, the operation link 33 reciprocates by the first cam member 31.

The central part of the second cam member 35 is connected with the hinge pin 37 of the opening/closing member 36, and a second cam shaft 34 is formed at the side part thereof. The second cam shaft 34 is assembled with the operation link 33. As the operation link 33 moves up and down, the second cam member 35 rotates.

When the driving motor 40 rotates the first cam member 31, the operation link 33 is moved up by the first cam member 31. When the operation member 33 is moved up, the second cam members 34 rotate, and then the opening/closing members 36 pivot about the hinge pins 37 by the second cam members 34. Then, the cool air discharge ports 16*a* are opened. In this situation, since all the cool air discharge ports 16*a* formed at the frontal side and at the lower side of the duct member 16 are opened, the cool air is supplied to the fresh food compartment 5 and the vegetable chamber 10.

When the temperature of the fresh food compartment 5 falls down to a lower temperature than the desired temperature, the opening/closing members 36 close the cool air discharge ports 16*a* according to the reverse operations to the above-mentioned operations. Therefore, the fresh food compartment 5 and the vegetable chamber 10 are not supplied with the cool air.

Although not shown in the figures, the opening/closing members for opening/closing the cool air discharge ports formed at the lower side of the duct member 16 are connected to driving motor 40 shown in FIG. 5 by a member such as another cam member, and if required, they can be driven by a separate driving motor.

In this embodiment, the opening/closing members 36 have, as shown in FIG. 5, parts 36*a* which are form-fittingly superposed with each other when they pivot to close the cool air discharge ports 16*a*. Since the adjacent two opening/closing members 36 are assembled with each other by form-fitting, there is no gap between the opening/closing members 36. Therefore, the cool air discharge ports 16*a* are closed more airtightly, and the leakage of the cool air when the cool air discharge ports 16 are open is efficiently prevented.

Although the present invention has been described and illustrated in detail, it is clearly understood that the same is by way of illustration and example only and is not to be taken by way of limitation, wherein the spirit and scope of the present invention is limited only by the terms of the appended claims.

What is claimed is:

1. A refrigerator comprising:

a body forming a cooling compartment and a vegetable chamber which are partitioned from each other;

an evaporator for generating cool air;

a duct member formed with a plurality of cool air discharge ports opened in said cooling compartment and said vegetable chamber, said duct member forming a cool air duct for guiding the cool air generated from said evaporator, and for discharging the cool air into said cooling compartment and said vegetable compartment through the cool air discharge ports; and a means for opening/closing the cool air discharge ports, comprising:

a plurality of opening/closing members pivotably installed near the cool air discharge ports for opening/closing the cool air discharge ports according to a pivotal position thereof;

a link with which said opening/closing members are hingedly assembled, said link being formed with a rack at a part thereof;

a pinion engaged with said rack; and means for driving said pinion.

2. A refrigerator comprising:

a body forming a cooling compartment and a vegetable chamber which are partitioned from each other;

an evaporator for generating cool air;

a duct member formed with a plurality of cool air discharge ports opened in said cooling compartment and said vegetable chamber, said duct member forming a cool air duct for guiding the cool air generated from said evaporator, and for discharging the cool air into said cooling compartment and said vegetable compartment through the cool air discharge ports; and a means for opening/closing the cool air discharge ports, comprising:

a plurality of opening/closing members pivotably installed near the cool air discharge ports for opening/closing the cool air discharge ports according to a pivoted position thereof;

a driving motor for driving said opening/closing member;

a first cam member rotatable by said driving motor;

a link reciprocable in response to rotation of said first cam member; and a plurality of second cam members for pivoting said opening/closing members, respectively, as said link reciprocates.

3. The refrigerator as claimed in claim 2 wherein each of said opening/closing members has a part superposed form-fittingly with each other when said opening/closing members pivot to close the cool air discharge ports.

* * * * *